US005947707A

United States Patent [19]

Felton

[11] Patent Number: 5,947,707

[45] Date of Patent: Sep. 7, 1999

[54] FUEL PUMP WITH A CAM HAVING FIRST AND SECOND PLUNGER DISPLACEMENT REGIONS

[75] Inventor: George Nicholas Felton, Kent, United Kingdom

[73] Assignee: Lucas Industries, United Kingdom

[21] Appl. No.: 08/858,476

[22] Filed: May 20, 1997

[30] Foreign Application Priority Data

May 22, 1996 [GB] United Kingdom ..... 9610774

[51] Int. Cl.[6] ..... F04B 19/02

[52] U.S. Cl. ..... 417/462; 417/440; 123/450; 123/506

[58] Field of Search ..... 417/278, 284, 417/486, 487, 488, 440, 505, 462; 123/387, 450, 506

[56] References Cited

U.S. PATENT DOCUMENTS

| | | | |
|---|---|---|---|
| 5,035,587 | 7/1991 | Collingborn | 417/440 |
| 5,044,893 | 9/1991 | Collingborn | 417/440 |
| 5,044,899 | 9/1991 | Nicol | 417/440 |
| 5,215,449 | 6/1993 | Ilija | 417/440 |

*Primary Examiner*—Charles G. Freay
*Attorney, Agent, or Firm*—Jenner & Block

[57] ABSTRACT

A fuel pump is disclosed which comprises a plunger reciprocable under the influence of a cam surface. The cam surface is shaped to include a first region and a second region. As the plunger moves under the influence of the first region, a pressure wave is generated which is able to reach a spill valve prior to the plunger moving under the influence of the second region to generate a pressure sufficient to open a delivery valve.

4 Claims, 2 Drawing Sheets

FUEL PUMP WITH A CAM HAVING FIRST AND SECOND PLUNGER DISPLACEMENT REGIONS

BACKGROUND OF THE INVENTION

1. Field of the Invention

This invention relates to a fuel pump, and in particular to a spill pump which is capable of delivering a low minimum quantity of fuel.

2. Description of the Related Art

One example of a known fuel pump is a rotary spill pump for supplying fuel to a four cylinder engine which comprises a distributor member which is rotatable within a sleeve. The distributor member includes an enlarged region which extends out of the sleeve and is rotatable within a cam ring, the enlarged region being provided with four equi-angularly spaced, radially extending plunger bores within which respective plungers are reciprocable. The plungers engage respective shoe and roller arrangements which, in turn, engage the cam surface of the cam ring. As the distributor member rotates, the plungers slide within the bores under the influence of the cam surface.

The distributor member is provided with an axially extending passage which communicates with the plunger bores and with a delivery passage which is arranged to register with four delivery ports provided in the sleeve, in turn, upon rotation of the distributor member to permit delivery to the injectors of an associated engine in turn. The axially extending passage also communicates with an inlet arrangement whereby fuel is supplied, at relatively low pressure, to the plunger bores.

A spill valve communicates with the axially extending passage, the spill valve comprising a piston member carrying a valve member which is engageable with a seating defined around an end of the axially extending passage. The piston member is spring biased towards a position in which the valve member engages the seating. The spill valve is fuel pressure actuated, movement of the valve member occurring when high pressure fuel is applied to a surface of the piston member, the application of such high pressure fuel to the surface of the piston member being controlled by an electromagnetically actuable control valve.

In use, after the rollers have ridden over the crests of the cam lobes, fuel is supplied to the plunger bores pushing the plungers outwardly. When the plungers engage the leading flanks of the next cam lobes, the plungers are pushed inwardly, pressurising the fuel in the plunger bores and supplying fuel at high pressure to the delivery passage and the selected one of the delivery ports. After a predetermined time, and hence after delivery of a predetermined quantity of fuel, the control valve is opened to apply high pressure fuel to the spill valve piston member to open the spill valve permitting fuel to flow to a spill chamber. The flow of fuel to the spill chamber permits the fuel pressure in the axially extending passage to fall; hence, fuel delivery is subsequently terminated.

After the rollers ride over the crests of the cam lobes, the spring returns the spill valve member into engagement with its seating, returning the fuel from the spill chamber to the plunger bores which are supplemented by fuel from the inlet arrangement. The pumping cycle then continues, the rotation of the distributor member resulting in the high pressure fuel being delivered to a different one of the delivery ports.

As the spill valve opens under the action of the application of high pressure fuel to the piston member, the minimum quantity of fuel which can be delivered by the pump is determined, in part, by the length of the flow path from the plunger bores to the spill valve by way of the control valve. In use, by the time the pressure wave generated by the inward movement of the plungers has passed the control valve and reached the spill valve, a quantity of fuel has been delivered; thus, even if the control valve is left open to enable spill to occur as early as possible, some fuel will be delivered in each pumping cycle.

A number of other fuel pumps are known in which a pumping plunger is reciprocable under the influence of a cam surface. For example, in a known arrangement, the plunger is rotatable within a bore, and a cam surface is provided on an end of the plunger cooperating with a plurality of rollers to cause the plunger to reciprocate as it rotates. In another arrangement, a plurality of plungers are reciprocable under the influence of cam surfaces associated with a cam shaft, for example in an in-line pump, or where one or more unit injectors are used.

SUMMARY OF THE INVENTION

It is an object of the invention to provide a pump in which the minimum quantity of fuel delivered by the pump during each pumping cycle is reduced.

According to the present invention there is provided a fuel pump for use in supplying fuel to a fuel injector, the pump comprising a plunger reciprocable within a bore under the influence of a cam surface, and a trigger valve controlling communication between the bore and a spill valve, the cam surface including at least one cam lobe of a profile shaped to include a first region and a second region, movement of the plunger under the influence of the first region generating a pressure wave which is able to reach the spill valve before the subsequent movement of the plunger under the influence of the second region raises the pressure to a level sufficient to commence fuel delivery through the fuel injector.

The height of the first region is conveniently insufficient to generate a pressure wave of magnitude capable of opening an injection nozzle.

It will be understood that the provision of the first region enables a sufficiently large wave front to reach the spill valve, and hence open the spill valve, before delivery occurs; thus the minimum quantity of fuel which can be delivered in each pumping cycle is reduced.

The invention also relates to a cam ring suitable for use in such a fuel pump, the cam ring having a profile as described hereinbefore.

The invention will further be described, by way of example, with reference to the accompanying drawings.

DETAILED DESCRIPTION OF PREFERRED EMBODIMENT

Figure 1:
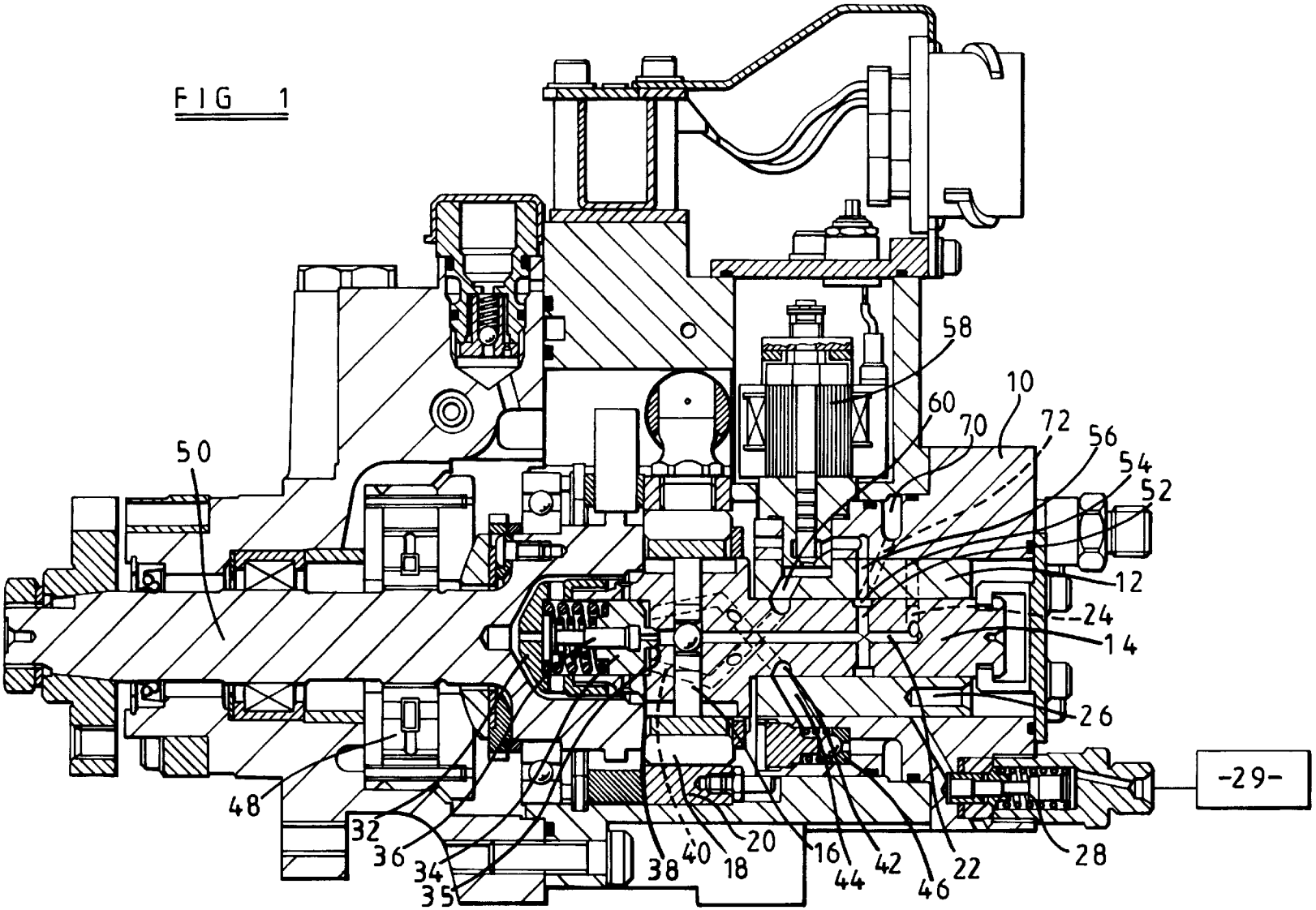
FIG. 1 is a cross-sectional view of a fuel pump.

The pump illustrated in FIG. 1 comprises a housing 10 within which a sleeve 12 is mounted, the sleeve 12 including a through bore within which a distributor member 14 is rotatable. The distributor member 14 includes an enlarged region in which a pair of perpendicular, diametrically extending plunger bores are provided, plungers 16 being reciprocable within the plunger bores. The outer end of each plunger 16 engages a respective shoe and roller arrangement 18 the roller of which engages a cam ring 20 such that as the distributor member 14 rotates with respect to the cam ring 20, the engagement between the roller and the cam surface of the cam ring 20 causes the plungers 16 to be pushed inwards within the respective plunger bores.

The distributor member 14 is provided with an axially extending passage 22 which communicates with the plunger bores, the passage 22 communicating with a radially extending delivery passage 24 which is registrable, upon rotation of the distributor member 14 with four equi-angularly spaced delivery ports 26 provided in the sleeve 12. Each of the delivery ports 26 communicates with an outlet valve 28 which is arranged to permit fuel to flow from the pump through the outlet valve 28 to a delivery line and injection nozzle (not shown) but to restrict the flow of fuel through the valve 28 in the reverse direction so as to ensure that the injection nozzle closes in a controlled manner at the end of each injection, and in order to damp shock waves within the delivery line.

A cap 32 is screw threaded to the enlarged part of the distributor member 14, the cap 32 together with the end of the distributor member 14 defining a cylinder within which a piston 34 is slidable. An end face of the piston 34 which faces the distributor member 14 is provided with a valve member 35 which is arranged to be engageable with a seating defined around the end of the axially extending passage 22, the piston being spring biased towards the position in which the valve member 35 engages the seating. The piston 34 is provided with a central bore of diameter substantially equal to the seating diameter within which a balance piston 36 is provided, a passage being provided in the valve member 35 to permit communication between the axially extending passage 22 and the bore of the piston 34. The piston 34 is therefore substantially pressure balanced.

The piston 34 and distributor member 14 define a chamber 38 which communicates through passages 40 provided in the distributor member 14 with an annulus 42. The annulus 42 is located so as to communicate with an inlet port 44 provided in the sleeve which in turn communicates with an inlet valve 46 arranged to receive fuel from a feed pump 48 which is driven by a drive shaft 50 which is keyed to, and hence drives the distributor member 14.

The axially extending passage 22 also communicates with radially extending passages 52 which communicate with ports 54 provided on the distributor member 14. The ports 54 communicate, in turn, with a passage 56 provided in the sleeve which communicates with the inlet of an electromagnetically operable control valve 58, the outlet of which communicates through a passage 60 with the annulus 42 provided on the distributor member 14.

The housing 10 is provided with an annular chamber 70 which is arranged to be supplied with fuel by the feed pump 48 through passages (not shown). Passages 72 communicate with the chamber 70, the passages 72 being arranged to register with the ports 54 as the distributor member 14 rotates to supply fuel to the plunger bores.

Figure 2:
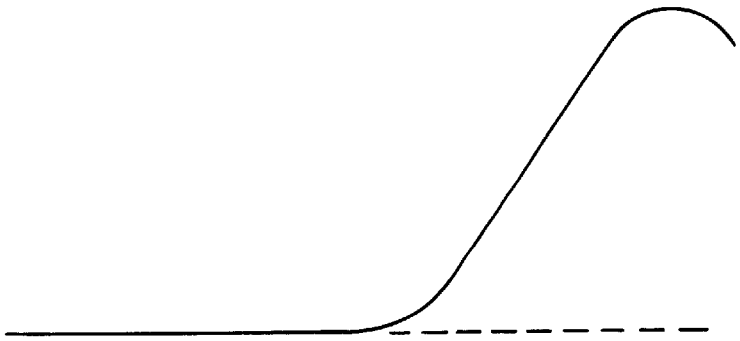
FIG. 2 is a cam profile diagram of part of a conventional cam ring.

Starting from the position shown in FIG. 1, fuel from the feed pump 48 is supplied to the chamber 70 and inlet valve 46 and from there to the annulus 42. The chamber 38 is therefore at relatively low pressure and the piston 34 occupies the position in which the valve member 35 thereof engages its seating; thus fuel flow from the axially extending passage 22 to the chamber 38 is prevented. Prior to closure of the control valve 58, fuel flow from the annulus 42 through the control valve 58 to the axially extending passage 22 commenced charging of the plunger bores. Upon closure of the control valve 58, such charging through the control valve was terminated. It will be appreciated that the charging could be terminated by the rotation of the distributor member breaking the communication between the port 54 and passage 56. Once charging of the plunger bores through the control valve 58 has terminated, further charging occurs from the chamber 70 via the passages 72. The charging of the plunger bores results in the plungers 16 occupying their radially outermost positions.

Where the cam ring 20 has the conventional profile illustrated in FIG. 2, rotation of the drive shaft 50 from the position shown in FIG. 1 brings the rollers into engagement with the leading flanks of the cam lobes provided on the cam ring 20 pushing the plungers 16 inwardly thus pressurising the fuel within the through bores and the axially extending passage 22. The rotation of the drive shaft 50 and hence of the distributor member 14 also brings the delivery passage 24 into alignment with one of the delivery ports 26. The inward movement of the plungers 16 therefore supplies fuel to that delivery port 26 and through the associated outlet valve 28 to the corresponding injector 29 of an associated engine. In order to terminate injection, the control valve 58 is opened to permit fuel to flow through one of the radial passages 52, associated port 54 and passage 56 provided in the sleeve 12, through the control valve 58 to the annulus 42 and from there through the passages 40 to the chamber 38. The application of high pressure fuel to the chamber 38, and hence to the end of the piston member 34 moves the piston member 34 against the action of the spring to lift the valve member 35 from its seating thus permitting fuel to flow from the axially extending passage 22 directly to the chamber 38. The movement of the piston member 34 acts to absorb the fuel delivered by the plungers 16 thus reducing the pressure of fuel supplied through the delivery port 26 and outlet valve 28 thereby terminating fuel delivery.

Continued movement of the drive shaft 50 and distributor member 14 breaks the communication between the delivery passage 24 and delivery port 26, and results in the rollers riding over the crests of the cam lobes provided on the cam ring 20. The plungers 16 are then able to move radially outwards, fuel being supplied to the plunger bores from the chamber 70 (as described hereinbefore) and from the chamber 38 under the action of the spring. In addition to the fuel being supplied from the chamber 70 and the chamber 38, fuel is supplied by the feed pump 48 through the inlet valve 46 to the annulus 42, some of this fuel flowing through the passages 40 to the chamber 38, the remaining fuel flowing through the control valve 58 to the axially extending passage 22. Subsequently, the control valve 58 is closed to break the communication between the annulus 42 and the axially extending passage 22, the valve member 35 being in engagement with its seating. If the control valve 58 is closed before filling is complete, continued filling is only from the chamber 70. Continued rotation of the drive shaft 50 brings the rollers into engagement with the leading flanks of the next cam lobes, and the pumping cycle is repeated, fuel being supplied to the next injector of the associated engine.

The quantity of fuel which is supplied to the engine is varied by altering the instant at which the control valve 58 is opened during the inward movement of the plungers 16 and in order to reduce the quantity of fuel supplied, the control valve 58 is opened earlier. When the control valve 58 is opened, a pressure wave travels from the control valve towards the piston 34 and this pressure wave takes a finite time to reach the piston 34. During this time, fuel continues to be supplied to the engine. Even if the control valve 58 is opened before the plungers 16 are moved inwardly with the cam lobes of the profile illustrated in FIG. 2, it can be expected that a quantity of fuel will be delivered to the engine before the spill valve opens. This quantity of fuel will tend to increase with increasing engine speed.

Figure 3:
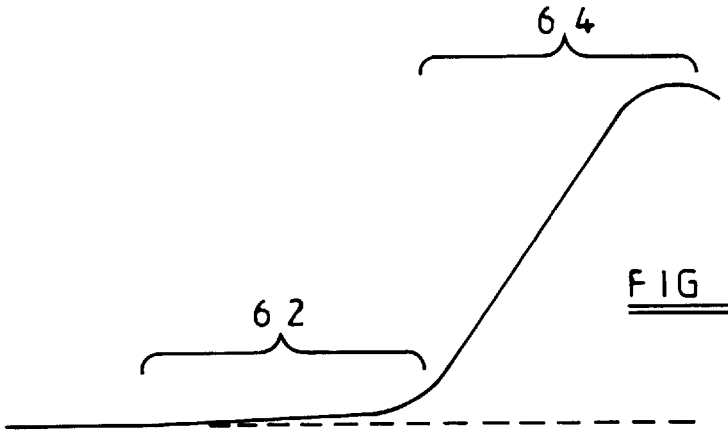
FIG. 3 is a view similar to FIG. 2 of a first embodiment.

In order to reduce the minimum quantity of fuel which can be delivered to the injector during each pumping cycle, the cam profile is modified to that illustrated in FIG. 3. The cam profile illustrated in FIG. 3 comprises a first region 62 and a second region 64. When the rollers ride over the first region 62, the plungers 16 are pushed inwardly by a relatively small amount thus generating a relatively low magnitude pressure wave which flows along the axially extending passage 22 towards the control valve 58. If the control valve 58 is open, the pressure wave flows through the passages 40 to the chamber 38 where it acts against the piston member 34. During the time taken for the pressure wave to reach the chamber 38, the rollers have moved along the first region but do not yet engage the second region 64 of the cam lobe, thus by the time the plungers 16 are moved inwardly at a greater rate due to their engagement with the second region 64, the projection of the piston member 34 is lifted from its seating. The fuel displaced by the inward movement of the plungers 16 can then be absorbed by the movement of the piston 34, thus the pressure within the axially extending passage 22 does not increase sufficiently to cause the injector to open.

Clearly, if the injector is to deliver some fuel, the control valve 58 is closed so as to prevent or delay the pressure wave from reaching the chamber 38, and hence to allow the pressure within the axially extending passage 22 to increase to an extent sufficient to cause fuel to be delivered through the injector. The presence of the first region does not significantly change the pump's characteristics when fuel delivery is required.

Figure 4:
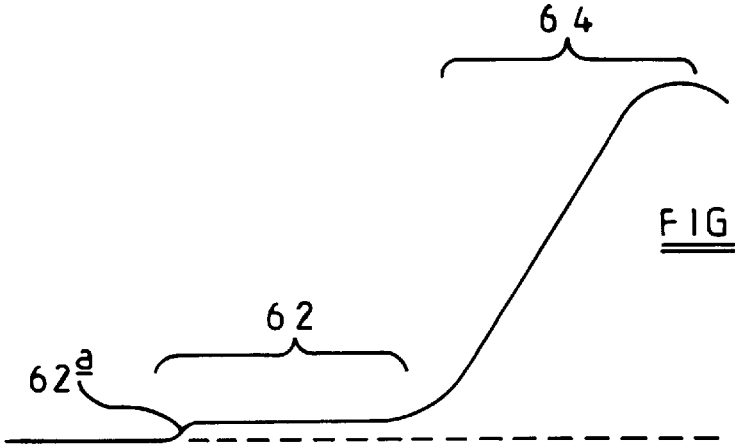
FIG. 4 is a view similar to FIG. 2 of a second embodiment.

FIG. 4 illustrates an embodiment in which the cam profile is modified so that the first region 62 includes a relatively steep leading flank 62*a* which causes inward movement of the plungers 16 to generate a well defined low magnitude pressure wave, and a region in which no further inward movement of the plungers 16 occurs until the rollers engage the second region 64 of the profile. Operation of this embodiment is as described hereinbefore.

In both of the embodiments, the pressure wave generated by the first region 62 is of magnitude insufficient to cause the injector to open, and hence is insufficient to cause delivery of fuel to the cylinder of the associated engine.

The description hereinbefore is of the use of the invention in a rotary fuel pump. It will be appreciated that the invention is also applicable to other types of fuel pumps, for example an in-line pump, the pump of a unit injector, or a rotary fuel pump of the type in which the cam surface is provided on an end of a rotary pumping plunger.

I claim:

1. A fuel pump for use in supplying fuel to a pressure operated valve of a fuel injector, the fuel pump comprising a plunger reciprocable within a bore under the influence of a cam surface of a cam, a spill valve, a passage between the bore and the spill valve, and a trigger valve within the passage controlling communication between the bore and the spill valve, the cam surface including at least one cam lobe of a profile shaped to include a first region and a second region, movement of the plunger under the influence of the first region generating a pressure wave which is able to reach the spill valve before the subsequent movement of the plunger under the influence of the second region raises the pressure to a level sufficient to overcome the pressure operated valve and cause fuel delivery through the fuel injector.

2. A fuel pump as claimed in claim 1, wherein the first region is shaped to cause the plunger to move relatively slowly, gradually increasing the fuel pressure within the bore.

3. A fuel pump as claimed in claim 1, wherein the first region is shaped to produce a rapid pressure increase, generating a well defined pressure wave.

4. A fuel pump as claimed in claim 1 wherein the cam surface forms part of a cam ring.

* * * * *